United States Patent [19]

Tomlinson

[11] Patent Number: 5,018,584

[45] Date of Patent: May 28, 1991

[54] FIRE SUPPRESSOR

[76] Inventor: John C. Tomlinson, 4096 N. Victoria St., Shoreview, Minn. 55126

[21] Appl. No.: 424,595

[22] Filed: Oct. 20, 1989

[51] Int. Cl.[5] ..... A62C 11/00

[52] U.S. Cl. ..... 169/30; 169/13

[58] Field of Search ..... 169/30, 34, 13; 239/146, 270, 308, 337, 375, 526

[56] References Cited

U.S. PATENT DOCUMENTS

| | | | |
|---|---|---|---|
| 1,953,331 | 4/1934 | Armstrong | 169/30 |
| 2,463,736 | 3/1949 | Benson | 169/30 |
| 2,606,701 | 8/1952 | Huthsing | 169/30 |
| 2,958,155 | 11/1960 | Emmerich | 43/148 |
| 3,040,471 | 6/1962 | Blase | 43/148 |
| 3,199,785 | 8/1965 | Schmierer | 239/153 |
| 3,586,238 | 6/1971 | Schmierer | 239/153 |
| 3,802,511 | 4/1974 | Good | 169/30 |
| 3,826,426 | 7/1974 | Bonvicini | 239/127 |
| 4,493,661 | 1/1985 | Iwai | 440/88 |
| 4,600,129 | 7/1986 | Kondo | 222/175 |
| 4,651,903 | 3/1987 | Pagliai | 222/175 |
| 4,658,778 | 4/1987 | Gamoh et al. | 123/195 |

*Primary Examiner*—Sherman D. Basinger
*Assistant Examiner*—Stephen P. Avila
*Attorney, Agent, or Firm*—Kinney & Lange

[57] ABSTRACT

A fire suppressor having a motor and a pump affixed to a tank for the fire suppressant mountable on the back of a user and which can be changed from a spray configuration to a fill configuration for fire site vicinity filling. A fuel tank for the motor mounted on the fire suppressant tank is enclosed to prevent sparks from reaching the fuel.

5 Claims, 5 Drawing Sheets

FIRE SUPPRESSOR

BACKGROUND OF THE INVENTION

The present invention relates to fire fighting equipment and, more particularly, to portable fire fighting equipment for use at locations which may be at some distance from regular supplies.

Control of unwanted fires to minimize losses is usually the desired response to the occurrence of such fires. This is true even for fires occurring in more remote areas because of the potential harm they might do in addition to the actual harm being done, areas in which, however, there often is not a water supply system available. This is often the situation for grass fires and forest fires.

In such instances, individual fire fighters with some kind of a reservoir on their backs must be dispatched to the relatively remote location if control of such fires is to be achieved. Typically, the contents of the reservoir used as a fire suppressant are discharged toward the fire as it is approached by the user through a hand pump arrangement. An individual fire fighter can carry only a relatively small amount of fire suppressant in the reservoir, and will tire fairly quickly from both carrying and hand pumping such suppressant onto the fire. Thus, there is a desire for a portable fire suppressor which will allow for more effective suppression of such fires by individuals sent to them for the purpose of controlling same.

SUMMARY OF THE INVENTION

The present invention provides a fire suppressor having a tank for containing a fire suppressant which can be mounted on the back of a user, and which has a fill opening at one end thereof and a flexible conduit connector at the opposite end, there being a motor with a coupled pump mounted on the suppressant tank with the pump having an inlet into which a first flexible conduit is connected that is conveniently connectable and disconnectable from the conduit connector, and having a second flexible conduit connected to the pump outlet which is conveniently connectable and disconnectable from a suppressant discharge head. The first flexible conduit can be connected to a strainer arrangement removably mounted on the suppressant tank so that the tank can be filled through the second flexible conduit at the fill opening. The pump motor operates on a liquid fuel provided in a fuel tank through a fill opening therein that can be covered by a filler cap, and which is stored in the fuel tank that is positioned in a recess in the suppressant tank, partially covered by a plate, and a movable cap cover which can entirely cover said filler cap or can be removed from being thereover.

DETAILED DESCRIPTION OF THE PREFERRED EMBODIMENTS

Figure 1:
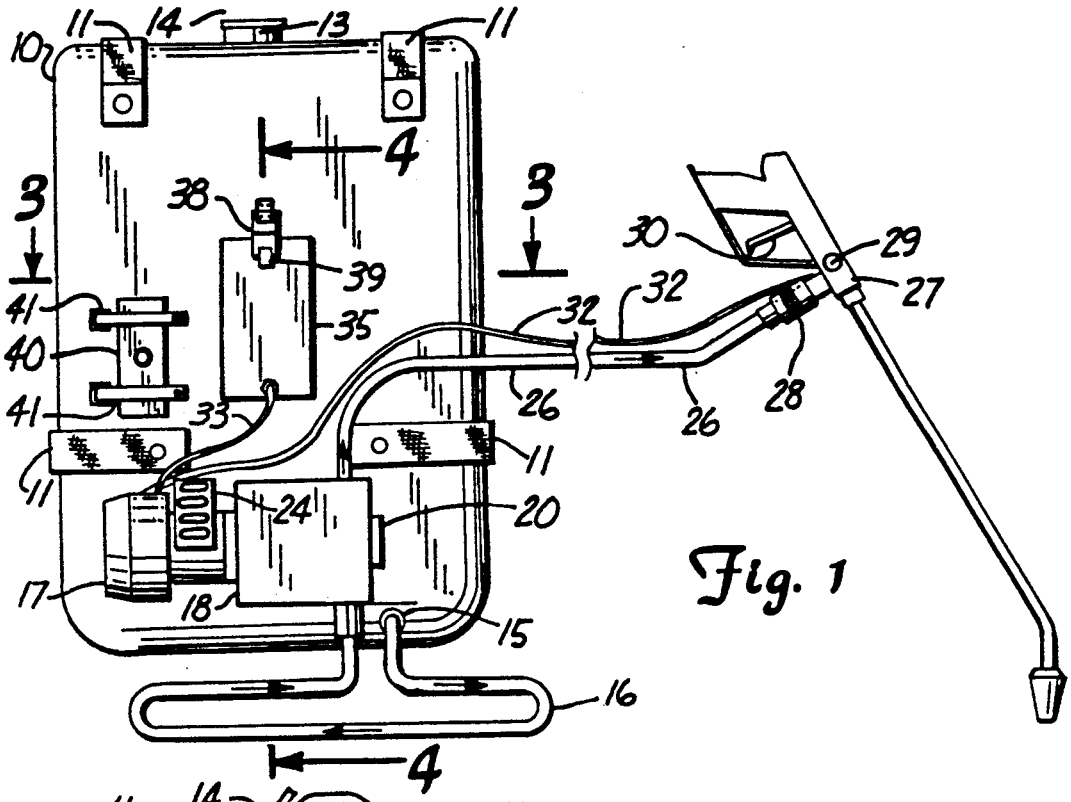
FIG. 1 shows a rear view of a fire suppressor embodying the present invention.
Figure 2:
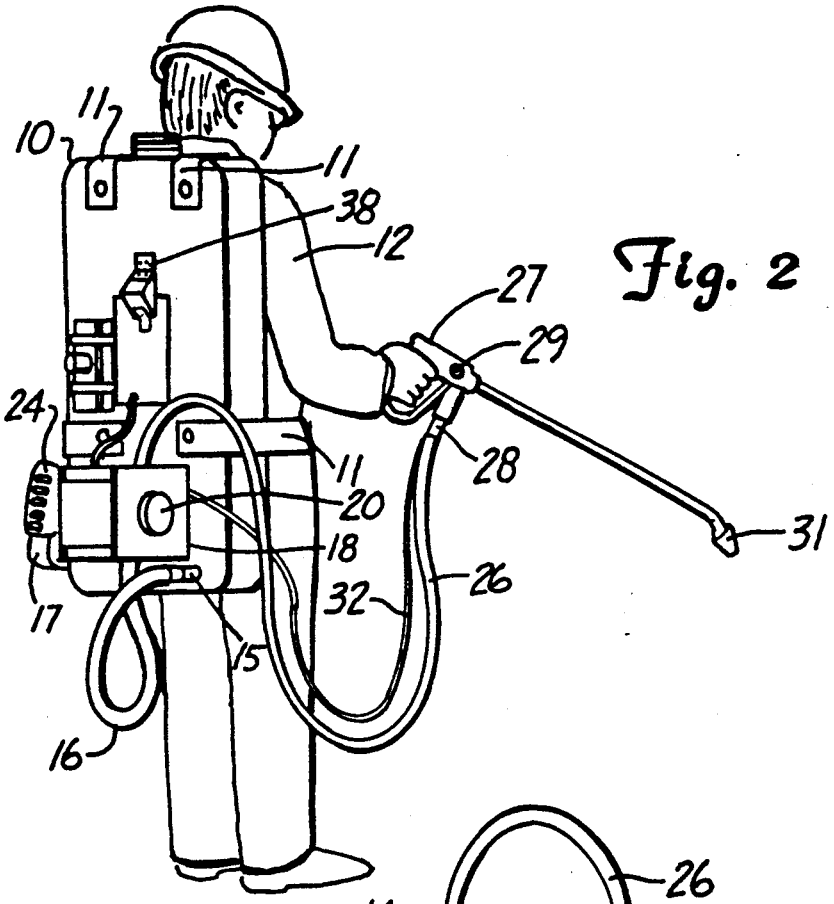
FIG. 2 shows the structure of FIG. 1 mounted on the back of a user.

FIG. 1 shows a rear view of a portable fire suppression apparatus embodying the present invention. A tank, 10, is provided as a reservoir for storing a quantity of a fire suppressant such as water. Tank 10 is molded in a custom mold provided by a commercial molder in polyurethane so as to result in a wall thickness of 0.25 in. Straps, 11, are provided connected to tank 10 to enable mounting tank 10, and the parts of the remaining apparatus provided therewith, on the back of a user. Such an arrangement is shown in FIG. 2 where a user, 12, has a tank 10 with parts of the apparatus provided therewith mounted on his back, held there by straps 11.

Tank 10 has a fill spout, 13, with an opening provided therein, and with a filler cap, 14, provided therewith for covering that opening when desired and exposing that opening when that is alternatively desired. A further access is provided to tank 10 through a female portion of a "quick disconnect" hose coupler, 15, provided near the bottom of tank 10. The male portion of connector 15 is provided on a flexible hose, 16, the other end of which is connected to the inlet of a pump to be described below. Hose 16 is a high pressure hose which will withstand internal pressures of up to 300 psi, and typically has a swivel provided therewith immediately adjacent to the inlet of the pump.

Figure 3:
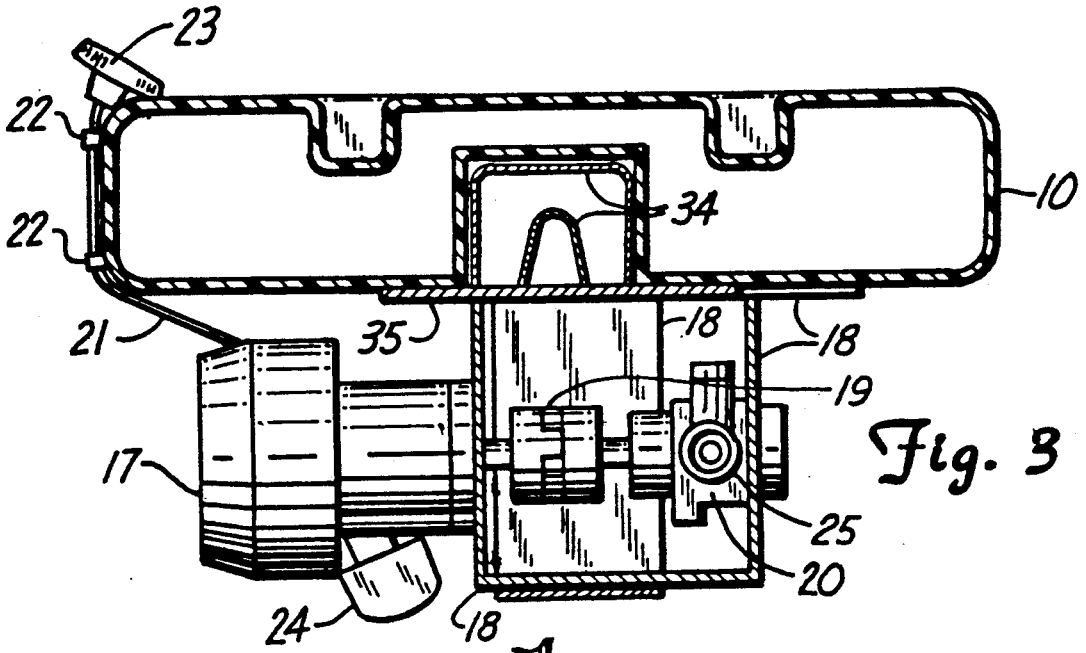
FIG. 3, shows a cross section view taken from FIG. 1.

The power for operating the pump to be described is supplied by an engine, 17, which is typically a one horsepower, two cycle gasoline engine, generally commercially available. Engine 17 can be more easily seen in the cross section view of FIG. 3, taken from FIG. 1, where it is seen being mounted on a shield, 18, in which is provided a torque coupler, 19, coupling the output shaft of engine 17 to a roller bearing pump, 20. The opposite end of pump 20 is also mounted in shield enclosure 18 which is affixed to tank 10. Engine 17 has a starter rope, 21, placed through guides, 22, such that a handle, 23, is presented to the side of the user. Pulling on starter rope 21 starts engine 17. Engine 17 has an exhaust muffler, 24, directing engine exhaust away from the fire suppression unit toward the rear. The outlet of pump 20 can be seen in FIG. 3 to have a pressure relief drip valve, 25, connected thereto, the hose usually attached to that valve not being shown. Coupler 19 and pump 20 are commercially available units, and pump 20 is capable of providing three-quarters of a gallon of water per minute.

A further high pressure hose, 26, is connected to pressure relief drip valve 25 at the outlet of pump 20, and hose 26 can be seen in FIG. 1 to extend to a suppressant discharge head, 27. Suppressant discharge head 27 in FIG. 1 is shown to be a triggerable spray wand having a female part of a further "quick disconnect" hose coupler, 28, provided therein. The male part of this coupler is connected to hose 26. Again, hose 26 is a high pressure hose capable of withstanding pressures up to 300 psi.

An electrical switch under a button, 29, and a trigger arrangement, 30, control the operation of suppressant discharge head or spray wand 27. User 12 of FIG. 2 squeezing trigger arrangement 30 permits fire suppressant to be discharged from nozzle 31 on the end of wand 27 in the direction pointed by user 12 in approaching a fire. An electrical interconnection, 32, allows the pushing of button 29 to close the switch therebelow and cause engine 17 to cease operation.

Engine 17 is supplied fuel, typically gasoline, by a fuel line, 33, extending from a fuel tank, 34, mounted in a recess in tank 10 behind a protecting plate, 35. Fuel line 33 can be seen in FIGS. 1 and 2, but has been omitted in FIG. 3 for clarity. On the other hand, fuel tank 34 can be seen in FIG. 3, and is seen there to have a baffle therein to limit the sloshing of the fuel in that tank.

Figure 4:
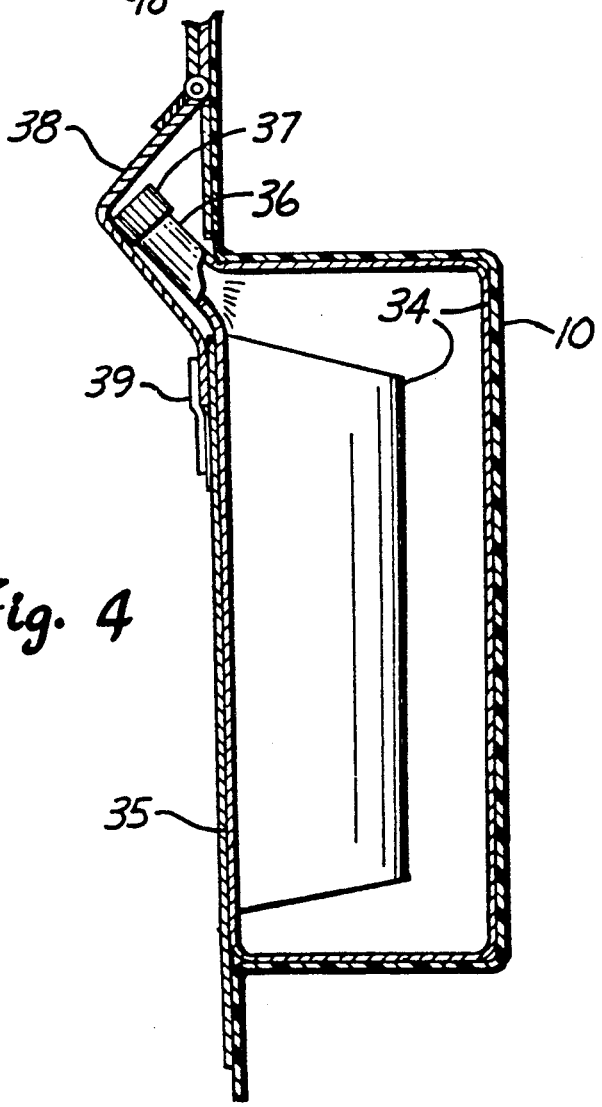
FIG. 4 shows a cross section view taken from a portion of FIG. 1.

FIG. 4, a cross section of that portion of FIG. 1 with fuel tank 34, shows more clearly the arrangement provided for that tank. Tank 34, set into the recess provided in the outer wall of suppressant tank 10, has a fill spout, 36, on which is provided a filler cap, 37. Most of fuel tank 34 is covered by either the recessed walls of suppressant tank 10, or by protective plate 35 affixed to tank 10. Spout 36, however, juts out past protective plate 35 and the walls of tank 10 to permit easy filling of tank 34 with fuel when filler cap 37 has been removed. Because of the volatility of gasoline and its vapors, and because of the use of the fire suppressant unit near fires where sparks may abound, a movable cap, 38, is provided affixed to tank 10. Cap 38 can be rotated up to expose filler cap 37 and rotated down to completely cover the remaining portions of tank 34 not covered by tank 10 and plate 35. A latch arrangement, 39, is used to keep cap 38 in place during the times it is to cover filler cap 37 and spout 36 of fuel tank 34. Thus, sparks can be kept entirely away from tank 34 to thereby prevent the possibility of ignition of the gasoline contained therein or the vapors which emanate therefrom.

FIG. 1 shows hoses 16 and 26 connected in the manner used when the fire suppression unit is on the back of user 12 for the purpose of suppressing a fire. In these circumstances, a fire suppressant such as water is pumped from suppressant tank 10 through coupler 15 and hose 16 by pump 20 where it is forced out through hose 26, wand 27 and nozzle 31 thereof. However, a user 12 can carry only a limited amount of fire suppressant in tank 10, and this must be replenished if user 12 is to continue effectively fighting the fire. Such replenishment can be difficult in remote areas if the user must return to a central dispensing station to obtain the necessary fire suppressant material. However, in remote areas streams, ponds or lakes are often available from which water could be drawn as a fire suppressant if the fire suppressant unit was capable of so doing. Of course, one could always dip into the stream and slowly fill tank 10 through filler cap 14 and spout 13 thereof, but such an operation would be extremely slow, limiting the effectiveness of user 12.

Figure 5:
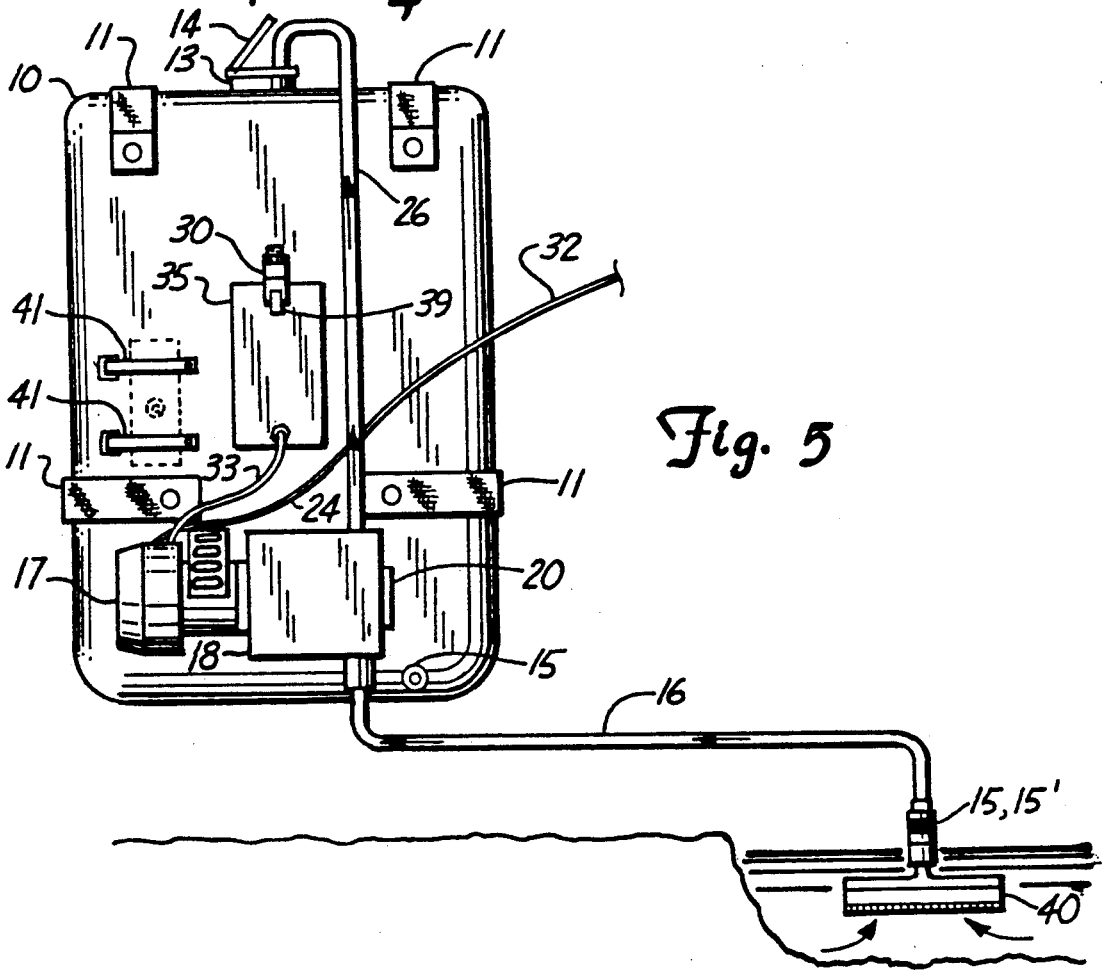
FIG. 5 shows an alternative arrangement of the structure of FIG. 1.
Figure 7:
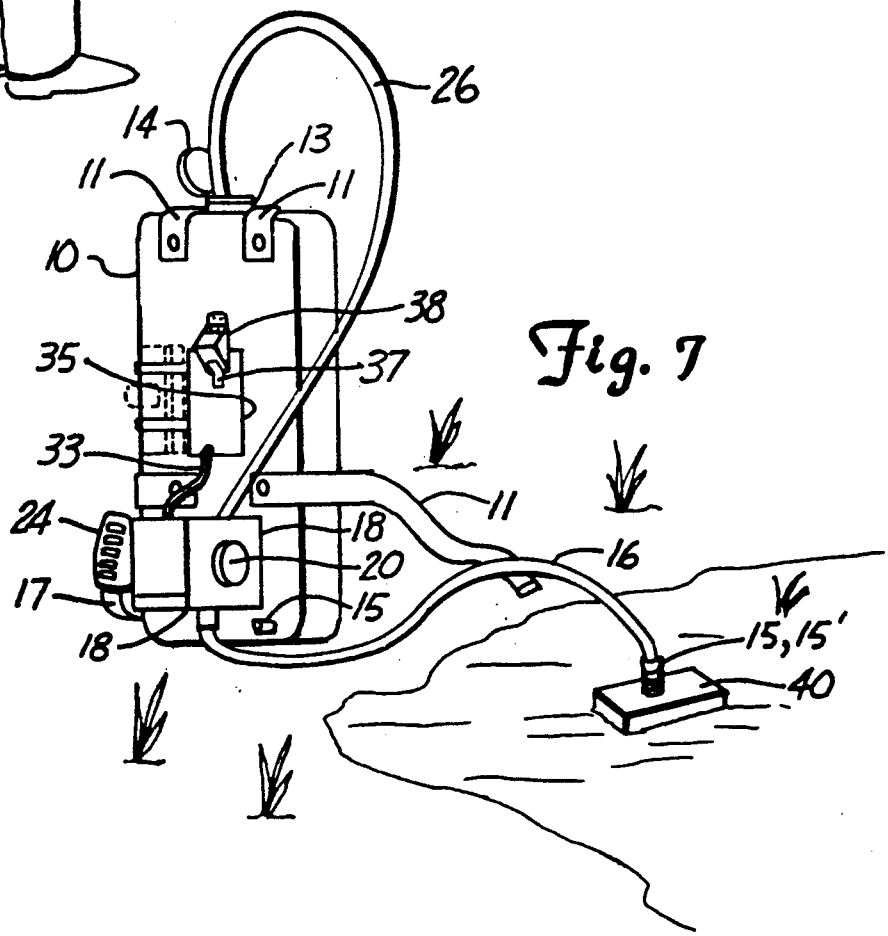
FIG. 7 shows use of the alternative arrangement of FIG. 6.
Figure 6:
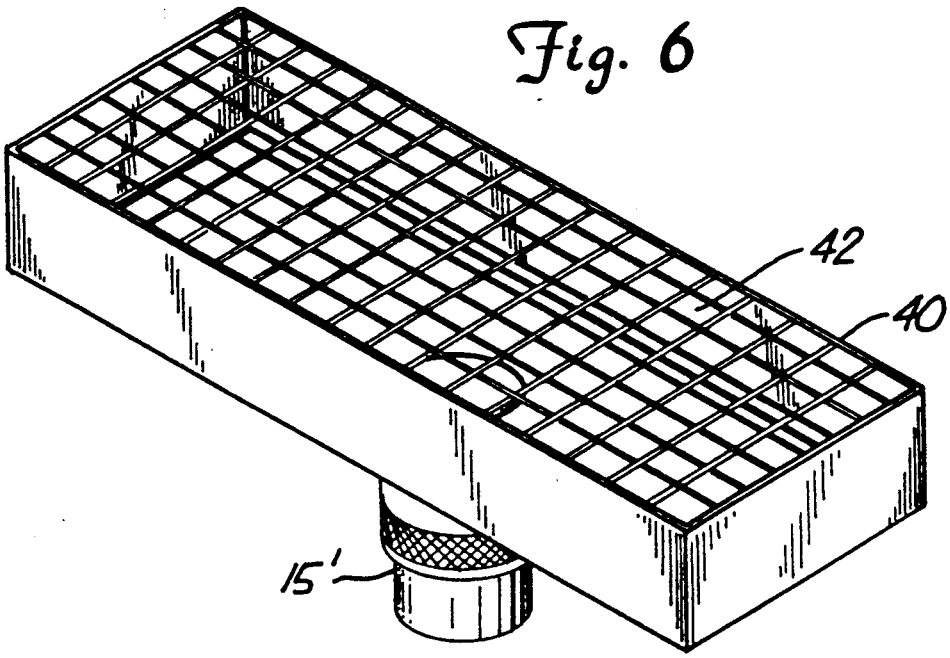
FIG. 6 shows a component taken from the structure of FIG. 1.

FIG. 5 shows the fire suppression unit of FIG. 1 reconfigured to make this a much quicker process. In this figure, hose 16 has been disconnected from coupler 15 and instead connected to a strainer arrangement, 40, which was previously removably mounted on tank 10 in FIG. 1 by a pair of fastening means, 41. Strainer 40, shown in FIG. 6, has a female portion of a "quick disconnect" coupler, 15', in which the male portion of "quick disconnect" coupler 15 has been engaged in FIG. 5. As can be seen in FIG. 6, strainer means 40 has connector 15' on one side of a rectangular box-like structure with the opposite side having a straining mesh, 42, provided to allow water to pass therethrough but to block the ingress of debris which may be harmful to pump 20. In FIG. 5, strainer 40 is shown submerged in a water source in such a manner that water therefrom can be drawn through hose 16 by pump 20 and, again, forced out hose 26. However, the male connector portion of connector 28 on hose 26 has been disconnected from the female portion thereof in wand 27, and this male portion of connector 28 has been inserted through spout 13 into tank 10 so that water forced along hose 26 thereby fills tank 10. As can be seen in FIG. 7, this is easily accomplished by having user 12 remove the fire suppression unit from his back by uncoupling straps 11 and placing the unit on the ground near a source of water. Once done, strainer 40 is placed in that source of water to draw water therefrom for filling tank 10. Because of the use of "quick disconnect" couplers for the hoses, and because of straps 11 also being quickly disconnected from one another, this refill operation can be accomplished quite quickly. The biggest increase in rapidity, though, is the elimination of the need to return to a central dispensing point for water. Rather, user 12 can make do with water wherever found in the vicinity of the fire.

Figure 8:
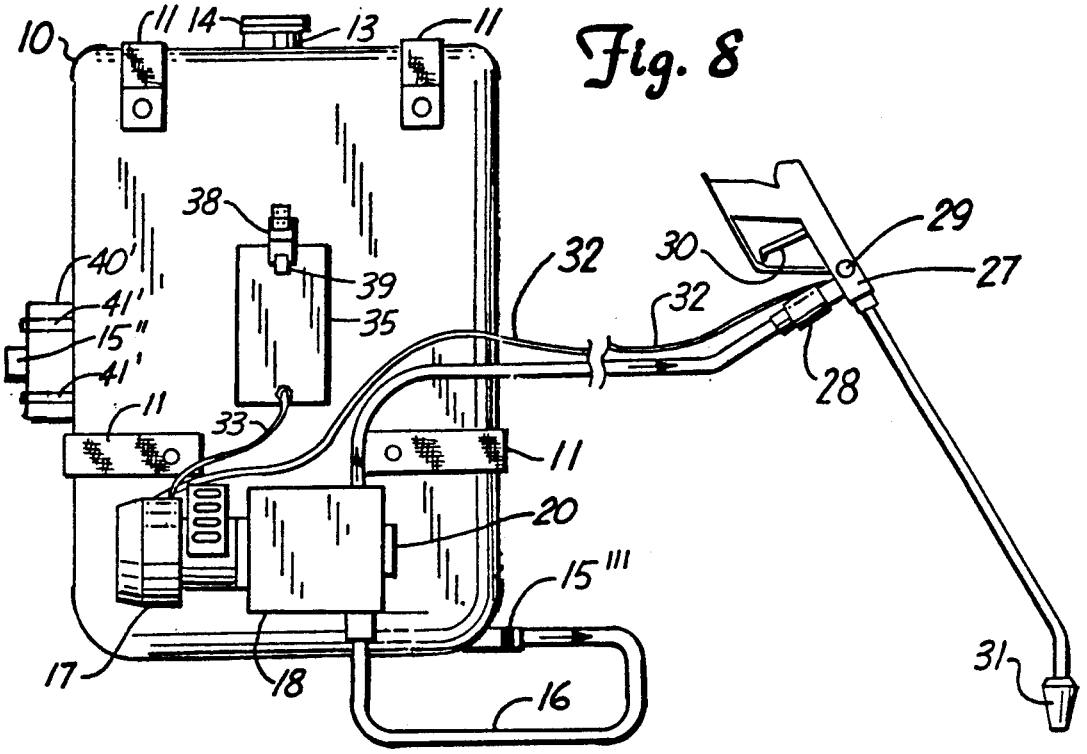
FIG. 8 shows an alternative embodiment of the structure of FIG. 1.

This rapidity of refilling can be further improved with a bit of rearrangement of the fire suppression unit shown in FIG. 1. This alternative can be seen in FIGS. 8 and 9. In these figures, the same designations are used as were used in the preceding figures to designate similar components in each.

Figure 9:
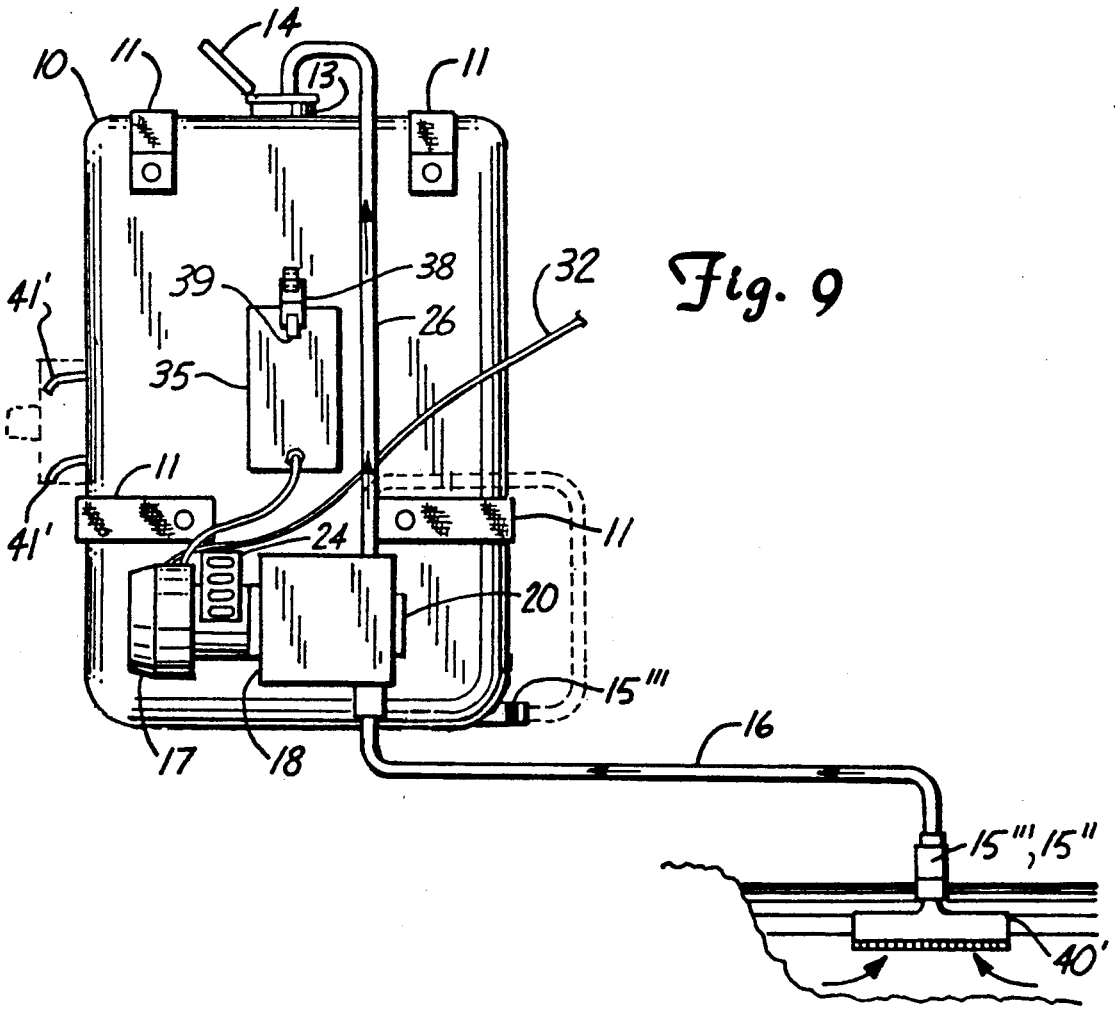
FIG. 9 shows an alternative arrangement of the structure of FIG. 8.

Instead of a "quick disconnect" coupler at the back of tank 10 in FIG. 1, a "quick disconnect" coupler, 15''',is mounted at the side of tank 10 in the position nearer user 12 so that user 12 can easily reach it for making that quick disconnect. Similarly, the strainer arrangement, 40', is mounted on the left side of tank 10, rather than the back, and closer to user 12 so that he can easily reach it. Again, strainer arrangement 40' is connected to tank 10 by fastener means, 41', which can be easily opened to permit user 12 to gain access to strainer 40'. Strainer 40' again has the female portion of a "quick disconnect" coupler, 15'', provided therein. As can be seen in FIG. 9, male coupler portion 15''' is connected with female coupler portion 15'' in strainer arrangement 40', and strainer arrangement 40' is then placed in a source of water for pump 20 to pump water through hose 26 into tank 10 through spout 13. However, user 12 can accomplish such a refill without the need for him to remove the fire suppression unit from his back. Such a capability again shortens the time required to refill tank 10.

Although the present invention has been described with reference to preferred embodiments, workers skilled in the art will recognize that changes may be made in form and detail without departing from the spirit and scope of the invention.

What is claimed is:

1. A pressurized fire suppressor which can be mounted on a user's back for selectively discharging a fire suppressant toward a fire approached by said user, and which has a reservoir which can be refilled with a fire suppressant available relatively nearby such a fire, said fire suppressor comprising:

a suppressant tank having a user's back mounting means affixed thereto, said suppressant tank having a fill opening at one end thereof and a first flexible conduit connector at an opposite end thereof;

a motor means coupled to a pump means both mounted on said suppressant tank, said pump means having an inlet and an outlet;

a first flexible conduit means which is connected to said pump means inlet, and which is also rapidly connectable to, and disconnectable from, said first flexible conduit connector and capable of passing a fire suppressant from said suppressant tank to said pump means when connected between each; and a second flexible conduit means which is connected to said pump means outlet, and which is also rapidly connectable to, and disconnectable from, a suppressant discharge head and capable of passing thereto a fire suppressant from said pump means when so connected.

2. The apparatus of claim 1 wherein said first flexible conduit means is also rapidly connectable to, and disconnectable from, a foreign matter screening means removably mounted upon said suppressant tank so as to permit said pump means to be capable of draining a fire suppressant from a source other than said suppressant tank.

3. The apparatus of claim 1 wherein said suppressant tank fill opening can accommodate that end of said second flexible conduit means which is connectable, and disconnectable from, said suppressant discharge head to permit a fire suppressant to pass through said second flexible conduit means into said suppressant tank.

4. A pressurized fire suppressor which can be mounted on a user's back for selectively discharging a fire suppressant toward a fire approached by said user, and which has a reservoir for said fire suppressant, said fire suppressor comprising:

a suppressant tank having a user's back mounting means affixed thereto;

a motor coupled to a pump means both mounted on said suppressant tank, said motor operating on a liquid fuel; and a fuel tank capable of containing said liquid fuel which can be provided within through a fill opening therein which can be covered by a filler cap, said fuel tank being positioned on a wall of said suppressant tank and, so positioned, having remaining portions thereof partially covered by a cover plate and further being capable of having that other part of said remaining portions near said fill opening covered by a movable cap cover which permits access to said filler cap when moved away therefrom but which entirely covers said filler cap when positioned thereover to prevent any sparks from a fire approached by a user from igniting any said liquid fuel provided therein or any vapors therefrom.

5. The apparatus of claim 4 wherein said fuel tank is positioned on said wall of said suppressant tank in a recess therein.

* * * * *